US006911591B2

(12) United States Patent
Akazawa et al.

(10) Patent No.: US 6,911,591 B2
(45) Date of Patent: Jun. 28, 2005

(54) RENDITION STYLE DETERMINING AND/OR EDITING APPARATUS AND METHOD

(75) Inventors: Eiji Akazawa, Hamamatsu (JP); Yasuyuki Umeyama, Hamamatsu (JP); Junji Kuroda, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 98 days.

(21) Appl. No.: 10/389,332

(22) Filed: Mar. 14, 2003

(65) Prior Publication Data

US 2003/0177892 A1 Sep. 25, 2003

(30) Foreign Application Priority Data

Mar. 19, 2002 (JP) ..... 2002-076674
Mar. 19, 2002 (JP) ..... 2002-076692

(51) Int. Cl.[7] ..... G10H 7/00
(52) U.S. Cl. ..... 84/616; 84/627
(58) Field of Search ..... 84/616, 627

(56) References Cited

U.S. PATENT DOCUMENTS 5,292,995 A 3/1994 Usa
6,150,598 A * 11/2000 Suzuki et al. ..... 84/603
6,281,423 B1 * 8/2001 Shimizu et al. ..... 84/622
6,452,082 B1 9/2002 Suzuki et al.
2003/0154847 A1 * 8/2003 Akazawa et al. ..... 84/627

FOREIGN PATENT DOCUMENTS

EP 1026 660 8/2000

* cited by examiner

*Primary Examiner*—Jeffrey W Donels
(74) *Attorney, Agent, or Firm*—Morrison & Foerster LLP

(57) ABSTRACT

Rendition style determining apparatus detects at least one of duration of a first note to be performed at a given time point and time interval between the first note and a second note to be performed following the first note, in order to automatically impart music piece data with an appropriate rendition style. Rendition style to be imparted to the music piece data in relation to the given time point is determined on the basis of the detected duration or time interval. Also, the apparatus can readily control the rendition style to be imparted to the music piece data, by appropriately setting/changing rendition style determination conditions, such as reference time lengths. Music piece data is supplied to a determination device, thereby causes the determination device to perform automatic rendition style determination based on the supplied music piece data and then displays the rendition style imparted to the music piece data.

22 Claims, 9 Drawing Sheets

RENDITION STYLE DISPLAYING/EDITING SCREEN

TO-BE-REPRODUCED-PORTION
DESIGNATING SCREEN

DETERMINATION CONDITION
INPUTTING SCREEN

RENDITION STYLE DETERMINING AND/OR EDITING APPARATUS AND METHOD

BACKGROUND OF THE INVENTION

The present invention relates to a rendition style determining apparatus and method for automatically imparting music piece data with additional musical expressions on the basis of characteristics of the music piece data; for example, the present invention relates to an improved rendition style determining apparatus and method which can automatically impart various different musical expressions to a same set of music piece data in response to simple setting operation by a user.

The present invention also relates to a rendition style displaying/editing apparatus and method which can perform a predetermined display on the basis of music piece data and edit the music piece data using the predetermined display, such as impartment of additional musical expressions to the music piece data, and more particularly to an improved rendition style displaying/editing apparatus and method which can acquire, from external equipment, additional musical expressions automatically imparted to music piece data by the external equipment on the basis of characteristics of the music piece data and display and edit the thus-acquired musical expressions.

Today, there are known and used automatic performance apparatus for automatically performing tones on the basis of music piece data, sequencers for editing music piece data, etc. The music piece data used in such automatic performance apparatus, sequencers, etc. comprise MIDI data corresponding to various notes and musical signs and marks on musical scores. Where pitches of a series of notes are designated by only tone pitch information, such as note-on and note-off information, an automatic performance of tones executed by reproducing the music piece data tends to result in a mechanical, expressionless and musically unnatural performance. To make the automatic performance musically natural, beautiful and vivid, it is generally very effective to impart the tones with various musical expressions corresponding to rendition styles and the like. There have been known automatic rendition style determining apparatus as apparatus intended to automatically add musical expressions to tones. The rendition style determining apparatus automatically impart music piece data with performance information pertaining to rendition styles (or articulation) that are representative of musical expressions and peculiar characteristics of a musical instrument. For example, the rendition style determining apparatus automatically search through a music piece data set for positions suitable for impartment of rendition styles, such as a staccato and legato, and then add performance information pertaining to the rendition styles, such as a staccato and legato, to music piece data at the searched-out positions.

However, with the conventionally-known automatic rendition style determining apparatus, the music piece data set, having been automatically imparted with rendition styles, sometimes fails to be as originally desired or intended by a user. Namely, with the conventional automatic rendition style determining apparatus, which are designed to automatically detect positions, within a music piece data set, that are suitable for impartment of predetermined rendition styles and then impart the rendition styles to the detected positions, same rendition styles would always be imparted to positions of same conditions within the music piece data set. Namely, because positions of same conditions within each music piece data set tend to be always automatically imparted with same rendition styles, the music piece data set is not necessarily imparted with rendition styles as originally intended by the user. In order to change the positions to be imparted with rendition styles and the rendition styles to be applied to the positions, it should suffice to change conditions or criteria for determining individual rendition styles as necessary, but, with the conventional technique, it is very difficult to change settings of the rendition style determining conditions due to complexity of the settings. Thus, where the user is a beginner, the user has no choice but to appropriately change the rendition styles at the predetermined positions, one by one, through manual operation. Such manual changing of the rendition styles is extremely time-consuming and thus tends to result in a very poor processing efficiency.

Further, because the conventional rendition style determining apparatus are unable to feed results of the automatic rendition style determination back to external equipment, such as a sequencer, connected to the determining apparatus, they would present the inconvenience that the user can not ascertain the results of the automatic rendition style determination except by actually reproducing the music piece data, having been thus imparted with the rendition styles, via the rendition style determining apparatus, Further, there have been known rendition style displaying/editing apparatus for editing rendition style information to be used to impart musical expressions. The rendition style displaying/editing apparatus are designed to display, on a screen, various rendition-style-containing performance information in a predetermined display style, such as a musical score display or piano roll display, on the basis of music piece data so that a user can use the screen to readily impart or delete performance information, representative of musical expressions and peculiar characteristics of a musical instrument, to or from the music piece data. With such rendition style displaying/editing apparatus, the user has to manually input desired rendition styles, one by one, to all appropriate positions of a music piece data set, so that an enormous amount of time would be required for the user to produce a music piece with desired rendition styles imparted thereto. As a consequence, the conventional rendition style displaying/editing apparatus would present the problem of an extremely poor efficiency.

SUMMARY OF THE INVENTION

In view of the foregoing, it is an object of the present invention to provide a rendition style determining apparatus and method which can automatically perform rendition style determination on the basis of music piece data. For example, the present invention seeks to provide a rendition style determining apparatus and method which can impart music piece data with user-desired expressions by changing, in accordance with rendition style determining conditions entered by the user, rendition styles to be imparted to the music piece data.

It is another object of the present invention to provide a rendition style determining apparatus and method which allow results of automatic rendition style determination to be output to external equipment, such as a sequencer, so that a user can ascertain the automatic rendition style determination results by other approaches than actually reproducing tones via the determining apparatus.

It is still another object of the present invention to provide a rendition style editing apparatus and method suitable for editing of rendition style information. For example, the present invention seeks to provide a rendition style displaying/editing apparatus and method which can receive, from predetermined external equipment, predetermined rendition styles to be imparted to music piece data in such a manner that the received rendition styles can be visually displayed and edited so that a user can impart the music piece data with desired musical expressions by just connecting to the external equipment.

According to an aspect of the present invention, there is provided a rendition style determining apparatus which comprises: a music piece data acquisition section that acquires music piece data for performing a given music piece; a detection section that, on the basis of the music piece data acquired by the music piece data acquisition section, detects at least one of duration of a first note to be performed at a given time point and a time interval between the first note and a second note to be performed following the first note; and a rendition style determination section that, on the basis of the at least one of the duration and time interval detected by the detection section, determines a rendition style to be imparted to the music piece data in relation to the given time point.

With the inventive arrangements, rendition styles can be automatically decided or determined on the basis of music piece data acquired by the music piece data acquisition section. Because the rendition style determination is performed on the basis of detection of duration of a first note to be performed at a given time point or a time interval between the first note and a second note to be performed following the first note, rendition styles can be automatically determined through relatively simple processing, without complicated processing operations.

The rendition style determining apparatus of the present invention may further comprise a condition setting section that sets a rendition style determination condition to be used as a criterion for the rendition style determination section to determine a rendition style. The rendition style determination condition may comprise one or more reference time lengths for determining each of one or more rendition styles. Further, the rendition style determination section may determine the rendition style to be imparted in relation to the given time point, by comparing the detected duration or time interval to the reference time lengths. Such arrangements allow the user of the apparatus to readily control a rendition style to be imparted to music piece data, by merely setting/changing the reference time lengths to be used as the rendition style determination condition or criterion.

According to another aspect of the present invention, there is provided a rendition style editing apparatus which comprises: a connection section for connecting thereto a determination processing section that performs rendition style determination on the basis of music piece data; an instruction section that generates a rendition style determination instruction to obtain a rendition style determined by the determination processing section; a music piece data supply section that, in response to the rendition style determination instruction generated by the instruction section, supplies music piece data to the determination section connected to the connection section and thereby causes the determination processing section to perform the rendition style determination based on the supplied music piece data; a reception section that receives a result of the rendition style determination from the determination processing section; and a display section that, on the basis of the result of the rendition style determination received by the reception section, displays information indicative of a rendition style having been determined by the determination processing section and imparted to the supplied music piece data.

In the rendition style editing apparatus, music piece data to be imparted with a rendition style are supplied to the determination processing section to thereby cause the determination processing section to perform the rendition style determination based on the supplied music piece data. Then, information indicative of a rendition style, having been determined and imparted to the music piece data, is visually displayed on the basis of a result of the rendition style determination. Therefore, by merely connecting the rendition style editing apparatus to the determination processing section via the connection section, it is possible to automatically impart a rendition style to the music piece data having no rendition style previously imparted thereto; in addition, the user can ascertain the determined and imparted rendition style through the visual display. Further, the invention permits the automatically-imparted rendition style to be edited as necessary; thus, the user can edit the rendition style with an increased efficiency.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE EMBODIMENTS

Figure 1:
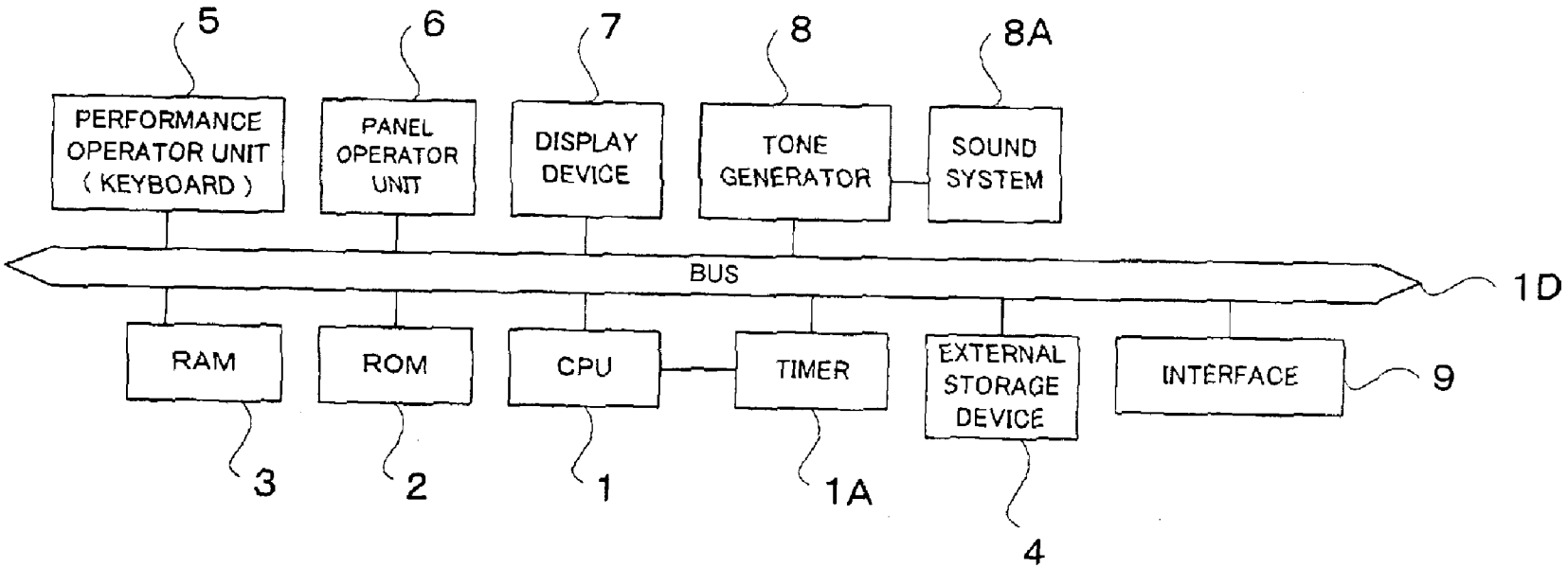
FIG. 1 is a block diagram showing an exemplary hardware organization of an electronic musical instrument employing a rendition style determining apparatus in accordance with an embodiment of the present invention.

FIG. 1 is a block diagram showing an exemplary hardware organization of an electronic musical instrument employing a rendition style determining apparatus in accordance with an embodiment of the present invention. The electronic musical instrument illustrated here is implemented using a computer, and predetermined automatic rendition style determining processing is carried out by the computer executing predetermined automatic rendition style determining processing programs (software). Of course, the automatic rendition style determining processing of the present invention may be implemented by microprograms to be executed by a DSP (Digital Signal Processor), rather than by such computer software. Also, the automatic rendition style determining processing of the present invention may be implemented by a dedicated hardware apparatus having discrete circuits or integrated or large-scale integrated circuit incorporated therein. Further, the rendition style determining apparatus of the present invention may be embodied as an electronic musical instrument, karaoke apparatus, electronic game apparatus, multimedia-related apparatus, personal computer or any other desired form of product. Namely, the rendition style determining apparatus of the present invention may be constructed in any desired manner as long as it can impart music piece data (music performance data) with rendition-style-related performance information on the basis of analyzed results of the music piece data. Note that, while the electronic musical instrument employing the rendition style determining apparatus to be described below may include other hardware than the above-mentioned, it will hereinafter be described in relation to a case where only necessary minimum resources are used.

In the electronic musical instrument of FIG. 1, various operations are carried out under control of a microcomputer including a microprocessor unit (CPU) 1, a read-only memory (ROM) 2 and a random access memory (RAM) 3. The CPU 1 controls behavior of the entire electronic musical instrument. To the CPU 1 are connected, via a communication bus (e.g., data and address bus) 1D, the ROM 2, RAM 3, external storage device 4, performance operator unit 5, panel operator unit 6, display device 7, tone generator 8 and interface 9. Also connected to the CPU 1 is a timer 1A for counting various times, for example, to signal interrupt timing for timer interrupt processes. Namely, the timer 1A generates tempo clock pulses for counting a time interval or setting a performance tempo with which to automatically perform a music piece in accordance with given music piece data. The frequency of the tempo clock pulses is adjustable, for example, via a tempo-setting switch of the panel operator unit 6. Such tempo clock pulses generated by the timer 1A are given to the CPU 1 as processing timing instructions or as interrupt instructions. The CPU 1 carries out various processes in accordance with such instructions. The various processes carried out by the CPU 1 in the instant embodiment include the "automatic rendition style determining processing" for automatically imparting music piece data with performance information relating to rendition styles (e.g., staccato and legato), peculiar to any of various musical instruments, in order to achieve more natural and vivid performances (to be later described in relation to FIG. 7).

The ROM 2 stores therein various data, such as music piece data to be imparted with rendition styles and waveform data (e.g., rendition style modules to be later described) corresponding to rendition styles peculiar to various musical instruments, and various programs, such as the "automatic rendition style determining processing" programs, to be executed or referred to by the CPU 1. The RAM 3 is used as a working memory for temporarily storing various data generated as the CPU 1 executes predetermined programs, or as a memory for storing a currently-executed program and data related to the currently-executed program. Predetermined address regions of the RAM 3 are allocated to various functions and used as various registers, flags, tables, memories, etc. Similarly to the ROM 2, the external storage device 4 is provided for storing various data, such as music piece data and waveform data, and various programs to be executed by the CPU 1. Where a particular control program is not prestored in the ROM 2, the control program may be prestored in the external storage device (e.g., hard disk device) 4, so that, by reading the control program from the external storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 4 may use any of various removable-type recording media other than the hard disk (HD), such as a floppy disk (FD), compact disk (CD-ROM or CD-RAM), magneto-optical disk (MO), digital versatile disk (DVD) and semiconductor memory. It should also be appreciated that other data than the above-mentioned may be stored in the ROM 2, external storage device 4 and RAM 3.

The performance operator unit 5 is, for example, a keyboard including a plurality of keys operable to select pitches of tones to be generated and key switches corresponding to the keys. This performance operator unit 5 can be used as input means for selecting a desired set of music piece data and for manually editing a rendition style as well as for executing a tone performance. It should be obvious that the performance operator unit 5 may be other than the keyboard, such as a neck-like device having tone-pitch-selecting strings provided thereon. The panel operator unit 6 includes music-piece-data selecting switches for selecting music piece data to be imparted with rendition styles, reproduction designating switch for calling a "to-be-reproduced-portion designating screen" to designate a portion or range of a music piece, determination condition inputting switch for calling a "determination condition inputting screen", and various other operators. Of course, the panel operator unit 6 may include other operators, such as a ten-button keypad for inputting numerical value data, keyboard for inputting text or character data and a mouse for operating a pointer to designate a desired position of a screen displayed on the display device 7. For example, the display device 7 comprises a liquid crystal display (LCD), CRT (Cathode Ray Tube) and/or the like, which visually displays various screens in response to operation of the corresponding switches, various information, such as music piece data and waveform data, and controlling states of the CPU 1.

The tone generator 8, which is capable of simultaneously generating tone signals in a plurality of tone generation channels, receives music piece data supplied via the communication bus 1D and generates tone signals on the basis of the received music piece data. Namely, as waveform data corresponding to music performance information included in the received music piece data are read out from the ROM 2 or external storage device 4, the read-out waveform data are delivered via the bus 1D to the tone generator 8 and stored in a buffer as necessary. Then, the tone generator 8 outputs the buffered waveform data at a predetermined output sampling frequency. Tone signals generated by the tone generator 8 are subjected to predetermined digital processing performed by a not-shown effect circuit (e.g., DSP (Digital Signal Processor)), and the tone signals having undergone the digital processing are supplied to a sound system 8A for audible reproduction or sounding.

The interface 9, which is, for example, a MIDI interface or communication interface, is provided for communicating various information between the electronic musical instrument and external music-piece-data generating equipment (not shown). The MIDI interface functions to input MIDI music piece data from the external music-piece-data generating equipment (in this case, other MIDI equipment or the like) to the electronic musical instrument or output MIDI music piece data from the electronic musical instrument to the external music-piece-data generating equipment. The other MIDI equipment may be of any type (or operating type), such as the keyboard type, guitar type, wind instrument type, percussion instrument type or gesture type, as long as it can generate MIDI data in response to operation by a user of the equipment. The communication interface is connected to a wired communication network (not shown), such as a LAN, Internet, telephone line network, or wireless communication network (not shown), via which the communication interface is connected to the external music-piece-data generating equipment (in this case, server computer or the like). Thus, the communication interface functions to input various information, such as a control program and music piece data, from the server computer to the electronic musical instrument. Namely, the communication interface is used to download particular information, such as a particular control program or music piece data set, from the server computer in a case where the information, is not stored in the ROM 2, external storage device 4 or the like. In such a case, the electronic musical instrument, which is a "client", sends a command to request the server computer to download the particular information, such as a particular control program or music piece data set, by way of the communication interface and communication network. In response to the command from the client, the server computer delivers the requested information to the electronic musical instrument via the communication network. The electronic musical instrument receives the particular information via the communication interface and accumulatively store it into the external storage device 4. In this way, the necessary downloading of the particular information is completed.

Note that where the interface 9 is the MIDI interface, it may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface, the other MIDI equipment connected with the electronic musical instrument may be designed to communicate other data than MIDI event data. Of course, the music information handled in the present invention may be of any other data format than the MIDI format, in which case the MIDI interface and other MIDI equipment are constructed in conformity to the data format used.

Figure 2A:
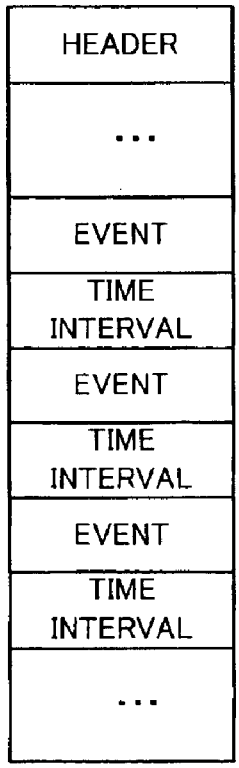
FIGS. 2A and 2B are conceptual diagrams explanatory of music piece data and waveform data handled in the electronic musical instrument.

Now, a description will be made about the music piece data and waveform data stored in the ROM 2, external storage device 4 or RAM 3, with reference to FIG. 2. FIG. 2A is a conceptual diagram explanatory of an example set of music piece data.

As shown in FIG. 2A, each music piece data set comprises music performance data that are, for example, representative of all tones in a music piece and are stored as a file of the MIDI format, such as an SMF (Standard MIDI file). Performance data in the music piece data set comprise combinations of timing data and event data. Each event data is performance event data pertaining to a performance event, such as a note-on event instructing generation of a tone, note-off event instructing deadening or silencing of a tone or rendition style designating event indicative of performance information relating to a rendition style. Each of the event data is used in combination with timing data. In the instant embodiment, each of the timing data is indicative of a time interval between two successive event data; however, each of the timing data may be data indicative of a relative time from a particular time point or an absolute time. Note that, according to the conventional SMF, times are expressed not by seconds or other similar time units, but by ticks that are units obtained by dividing a quarter note into 480 equal parts. Namely, the music performance data in the music piece data set handled in the instant embodiment may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. Furthermore, the music piece data set may be arranged in such a manner that event data are stored separately on a track-by-track basis, rather than being stored in a single row, irrespective of their assigned tracks, in the order the event data are to be output. Note that the music piece data set may include other data than the event data and timing data, such as tone generator control data (e.g., data for controlling tone volume and the like).

Figure 2B:
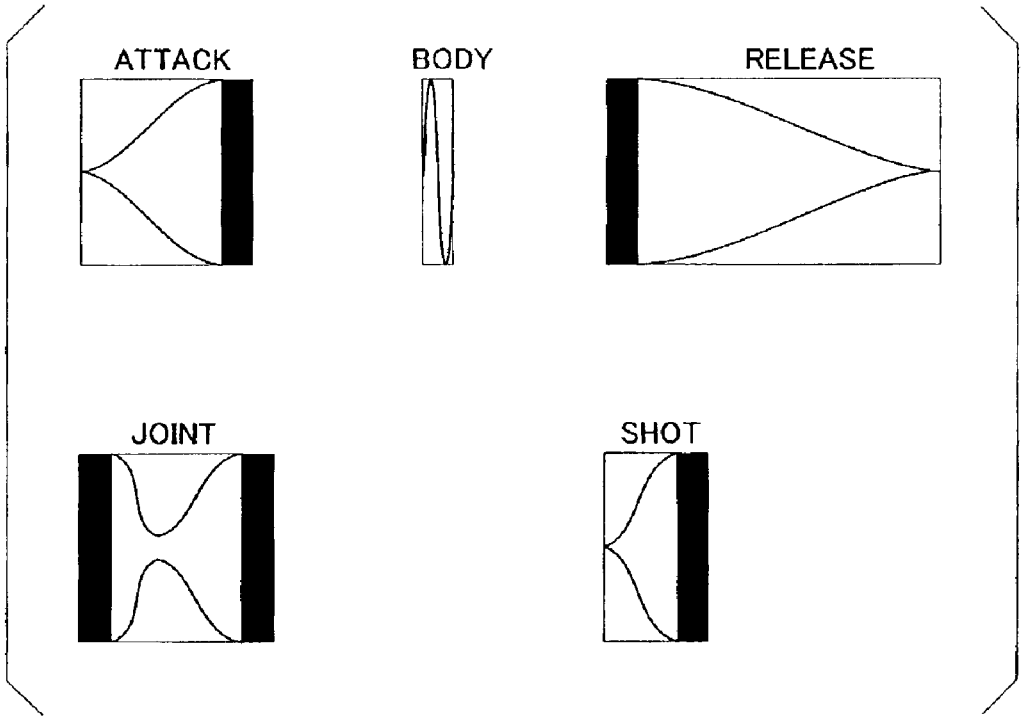

The following paragraphs describe the waveform data handled in the instant embodiment. FIG. 2B is a schematic view explanatory of examples of waveform data. Note that FIG. 2B shows cases where "rendition style modules" are used as waveform data sets corresponding to rendition styles peculiar to various musical instruments; specifically, the figure shows five rendition style modules: "attack-related" rendition style module; "body-related" rendition style module; "release-related" rendition style module; "joint-related" rendition style module; and "shot-tone-related" rendition style module. Note that, for convenience of illustration, each of the rendition style modules is denoted here in a simplified form using an envelope waveshape.

In the ROM 2, external storage device 4 and/or RAM 3, there are stored, as rendition style modules, a multiplicity of original rendition style waveform data sets and related data groups for reproducing waveforms corresponding to various rendition styles peculiar to various musical instruments. Note that each of the rendition style modules is a rendition style waveform unit that can be processed as a single data block in a rendition style waveform synthesis system; in other words, each of the rendition style modules is a rendition style waveform unit that can be processed as a single event. As seen from FIG. 2B, the rendition style waveform data sets of the various rendition style modules include in terms of characteristics of rendition styles of performance tones: those defined in correspondence with partial sections of each performance tone, such as attack, body and release portions (attack-related, body-related and release-related rendition style modules); those defined in correspondence with joint sections between successive tones such as a slur (joint-related rendition style modules); and those defined in correspondence with the whole of each tone in a special performance section, such as a staccato (shot-tone-related rendition style modules).

In the instant embodiment, the rendition style modules can be classified into several major types on the basis of characteristics of rendition styles, timewise segments or sections of performances, etc. For example, the following are seven major types of rendition style modules thus classified in the instant embodiment:

1) "Normal Entrance" (abbreviated NE): This is an attack-related rendition style module representative of (and hence applicable to) a rise portion (i.e., attack portion) of a tone from a silent state;

2) "Normal Finish" (abbreviated NF): This is a release-related rendition style module representative of (and hence applicable to) a fall portion (i.e., release portion) of a tone leading to a silent state;

3) "Normal Joint" (abbreviated NJ): This is a joint-related rendition style module representative of (and hence applicable to) a joint portion interconnecting two successive tones with no intervening silent state;

4) "Slur Joint" (abbreviated SJ): This is a joint-related rendition style module representative of (and hence applicable to) a joint portion interconnecting two successive tones by a slur with no intervening silent state;

5) "Normal Short Body" (abbreviated NSB): This is a body-related rendition style module representative of (and hence applicable to) a short non-vibrato-imparted portion of a tone in between the rise and fall portions (i.e., non-vibrato-imparted body portion of the tone);

6) "Vibrato Body" (abbreviated VB): This is a body-related rendition style module representative of (and hence applicable to) a vibrato-imparted portion of a tone in between the rise and fall portions (i.e., vibrato-imparted body portion of the tone); and 7) "Shot": This is a shot-related rendition style module representative of (and hence applicable to) the whole of a short tone (i.e., shot tone) that includes both a rise portion (i.e., attack portion) following a silent state and a fall portion (i.e., release portion) leading to a silent state and that has a shorter length or duration than a normal tone.

It should be appreciated here that the classification into the above seven rendition style module types is just illustrative, and the classification of the rendition style modules may of course be made in any other suitable manner; for example, the rendition style modules may be classified into more than seven types. Further, the rendition style modules may also be classified according to original tone sources, such as musical instruments.

Further, in the instant embodiment, the data of each rendition style waveform corresponding to one rendition style module are stored in a database as a data set of a plurality of waveform-constituting factors or elements, rather than being stored merely as originally input; each of the waveform-constituting elements will hereinafter be called a vector. As an example, each rendition style module includes the following vectors. Note that "harmonic" and "nonharmonic" components are defined here by separating an original rendition style waveform in question into a waveform segment having a pitch-harmonious component (harmonic component) and the remaining waveform segment having a non-pitch-harmonious component (nonharmonic component).

1) Waveform shape (timbre) vector of the harmonic component: This vector represents only a characteristic of a waveform shape extracted from among the various waveform-constituting elements of the harmonic component and normalized in pitch and amplitude.

2) Amplitude vector of the harmonic component: This vector represents a characteristic of an amplitude envelope extracted from among the waveform-constituting elements of the harmonic component.

3) Pitch vector of the harmonic component: This vector represents a characteristic of a pitch extracted from among the waveform-constituting elements of the harmonic component; for example, it represents a characteristic of timewise pitch fluctuation relative to a given reference pitch.

4) Waveform shape (timbre) vector of the nonharmonic component: This vector represents only a characteristic of a waveform shape (noise-like waveform shape) extracted from among the waveform-constituting elements of the nonharmonic component and normalized in amplitude.

5) Amplitude vector of the nonharmonic component: This vector represents a characteristic of an amplitude envelope extracted from among the waveform-constituting elements of the nonharmonic component.

The rendition style waveform data of the rendition style module may include one or more other types of vectors, such as a time vector indicative of a time-axial progression of the waveform, although not specifically described here.

For synthesis of a rendition style waveform, waveforms or envelopes corresponding to various constituent elements of the rendition style waveform are constructed along a reproduction time axis of a performance tone by applying appropriate processing to these vector data in accordance with control data and arranging or allotting the thus-processed vector data on or to the time axis and then carrying out a predetermined waveform synthesis process on the basis of the vector data allotted to the time axis. For example, in order to produce a desired performance tone waveform, i.e. a desired rendition style waveform exhibiting predetermined ultimate rendition style characteristics, a waveform segment of the harmonic component is produced by imparting a harmonic component's waveform shape vector with a pitch and time variation characteristic thereof corresponding to a harmonic component's pitch vector and an amplitude and time variation characteristic thereof corresponding to a harmonic component's amplitude vector, and a waveform segment of the nonharmonic component is produced by imparting a nonharmonic component's waveform shape vector with an amplitude and time variation characteristic thereof corresponding to a nonharmonic component's amplitude vector. Then, the desired performance tone waveform can be produced by additively synthesizing the thus-produced harmonic and nonharmonic components' waveform segments.

Each of the rendition style modules includes rendition style waveform data and rendition style parameters, as illustrated in FIG. 2B. The rendition style parameters are parameters for controlling the time, level etc. of the waveform in question. The rendition style parameters may include one or more kinds of parameters depending on the nature of the rendition style module. For example, the "Normal Entrance" rendition style module may include different kinds of rendition style parameters, such as an absolute tone pitch and tone volume at the beginning of generation of a tone, the "Normal Short Body" rendition style module may include different kinds of rendition style parameters, such as an absolute tone pitch of the module, start and end times of the normal short body and dynamics at the beginning and end of the normal short body. These "rendition style parameters" may be prestored in the ROM 2 or the like, or may be entered by user's input operation. The existing rendition style parameters may be modified via user operation. Further, in a situation where no rendition style parameter is given at the time of reproduction of a rendition style waveform, predetermined standard rendition style parameters may be automatically imparted. Furthermore, suitable parameters may be automatically produced and imparted in the course of processing.

Figure 3:
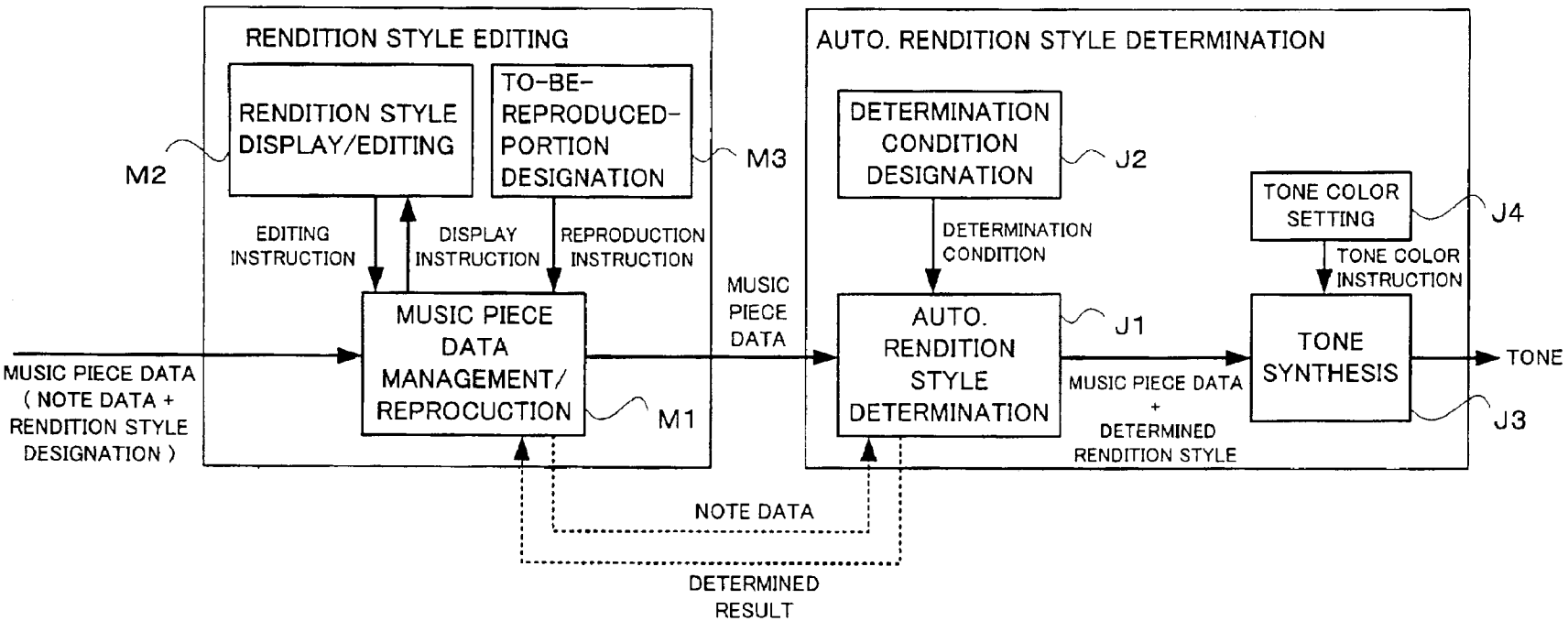
FIG. 3 is a functional block diagram explanatory of an automatic rendition style determining function and rendition style editing function performed by the electronic musical instrument.

The electronic musical instrument shown in FIG. 1 has not only an automatic rendition style determining function for automatically imparting a rendition style to music piece data read out from, for example, the ROM 2, external storage device 5 or the like, but also a rendition style displaying/editing function for allowing the user to edit visually-displayed music piece data. These automatic rendition style determining function and rendition style displaying/editing function are outlined below with reference to FIG. 3. FIG. 3 is a functional block diagram explanatory of the automatic rendition style determining function and rendition style displaying/editing function performed by the electronic musical instrument, where data flows between various components are indicated by arrows. Note that the embodiment will be described in relation to a case where, in the single electronic musical instrument, the automatic rendition style determining function is performed as one function of a software tone generator executed by the CPU 1 while the rendition style displaying/editing function is performed as one function of a software sequencer executed by the CPU 1. Of course, the automatic rendition style determining function and rendition style displaying/editing function may be performed by a predetermined hardware tone generator and sequencer imparted with the above-mentioned functions, instead of using the software tone generator and sequencer.

In FIG. 3, a music-piece-data management/reproduction section M1 acquires a desired music piece data set from the ROM 2, external storage device 4 or the like, for example, in response to user selection of the desired music piece data set via the music-piece-data selecting switches. As explained earlier, the music piece data set comprises note data, including note-on and note-off event data, rendition style designating event data, etc. Once acquisition of the music piece data set is completed, the music-piece-data management/reproduction section M1 issues, to a rendition style displaying/editing section M2, a screen display instruction for visually displaying the acquired music piece data and rendition style data on the display device 7 in respective predetermined display styles. In accordance with the screen display instruction from the management/reproduction section M1, the rendition style displaying/editing section M2 displays the "rendition style displaying/editing screen" (see FIG. 4) on the display device 7. To-be-reproduced-portion designating section M3 displays the "to-be-reproduced-portion designating screen" (see FIG. 5) on the display device 7 in response to operation of the reproduction designating switch and receives a reproduction instruction given via the to-be-reproduced-portion designating screen. The music-piece-data managing/reproducing section M1 sequentially supplies an automatic rendition style determining section J1 with the music piece data that have been divided into predetermined quantities to be stream-reproduced in response to a reproduction instruction given by the to-be-reproduced-portion designating section M3.

In turn, the automatic rendition style determining section J1 carries out the "automatic rendition style determining processing" (see FIG. 7) to automatically impart rendition styles to the received music piece data. Determination condition designating section J2 displays the "determination condition inputting screen" (see FIG. 6) on the display device 7 in response to operation of the determination condition inputting switch, and it receives rendition style determination conditions, to be used as criteria for automatically imparting rendition styles, input by the user via the determination condition inputting screen. Namely, in accordance with the rendition style determination conditions given from the determination condition designating section J2, the automatic rendition style determining section J1 automatically imparts predetermined rendition styles (determined rendition styles) only to notes in the music piece data set that are previously imparted with no rendition style. Then, the automatic rendition style determining section J1 sends the music piece data, having been imparted with the determined rendition styles, to a tone synthesizing section J3. Then, the tone synthesizing section J3 performs tone synthesis on the basis of the music piece data, having been imparted with the determined rendition styles and supplied by the automatic rendition style determining section J1, and it outputs thus-synthesized tones with tone colors instructed via a tone color setting section J4; namely, rendition-style-imparted tones, including the automatically-imparted rendition styles, are output from the tone synthesizing section J3.

In addition to the above function of automatically imparting rendition styles to the music piece data in accordance with progression of stream-reproduction of the music piece data to thereby output rendition-style-imparted tones, the automatic rendition style determining section J1 performs a function of receiving a plurality of note-on and note-off events from the music-piece-data managing/reproducing section M1 and returning only automatically-imparted rendition styles ("determined rendition styles") to the music-piece-data managing/reproducing section M1 on the basis of the received note-on and note-off events, as depicted by a broken line in FIG. 3. Namely, irrespective of the reproduction instruction received from the to-be-reproduced-portion designating section M3, the music-piece-data managing/reproducing section M1 independently issues, to the automatic rendition style determining section J1, a rendition style determination instruction to instruct the determining section J1 to perform automatic rendition style determination and then receives results of the automatic rendition style determination (determined rendition styles) from the rendition style determining section J1. In such a case, the music-piece-data managing/reproducing section M1 issues, to the rendition style displaying/editing section M2, a screen display instruction based on the received music piece data and determined rendition styles, so that each rendition style automatically imparted by the rendition style determining section J1 can be visually displayed on the rendition style displaying/editing screen. In this way, the user is allowed to visually ascertain rendition styles currently imparted to the music piece data, including the automatically-determined rendition styles, and readily change or delete any of the rendition styles by use of the rendition style displaying/editing screen. Detailed description of the rendition style displaying/editing screen will be given later. In such on-demand rendition style impartment in the instant embodiment, the music-piece-data managing/reproducing section M1 requests optimal rendition styles to be applied only to notes currently displayed on the rendition style displaying/editing screen, rather than rendition styles to be applied to the entire music piece; of course, such a rendition style determination instruction is given only for notes having no rendition style manually imparted thereto in advance. The algorithm for instructing the automatic rendition style determination in the instant embodiment (to be described in relation to FIGS. 7–9) is generally similar to the aforementioned algorithm for imparting rendition styles to the music piece data in accordance with progression of stream-reproduction of the music piece data, but different from the latter in that it does not reproduce the music piece data and thus outputs no rendition style designating event.

Namely, the rendition style determining section J1 can output the rendition style determination results alone so that the determination results are fed back to the rendition style displaying/editing section M2. In this way, the rendition style determination results (determined rendition styles) can be checked or ascertained and modified, as necessary, without the music piece data being reproduced at all.

Figure 4:
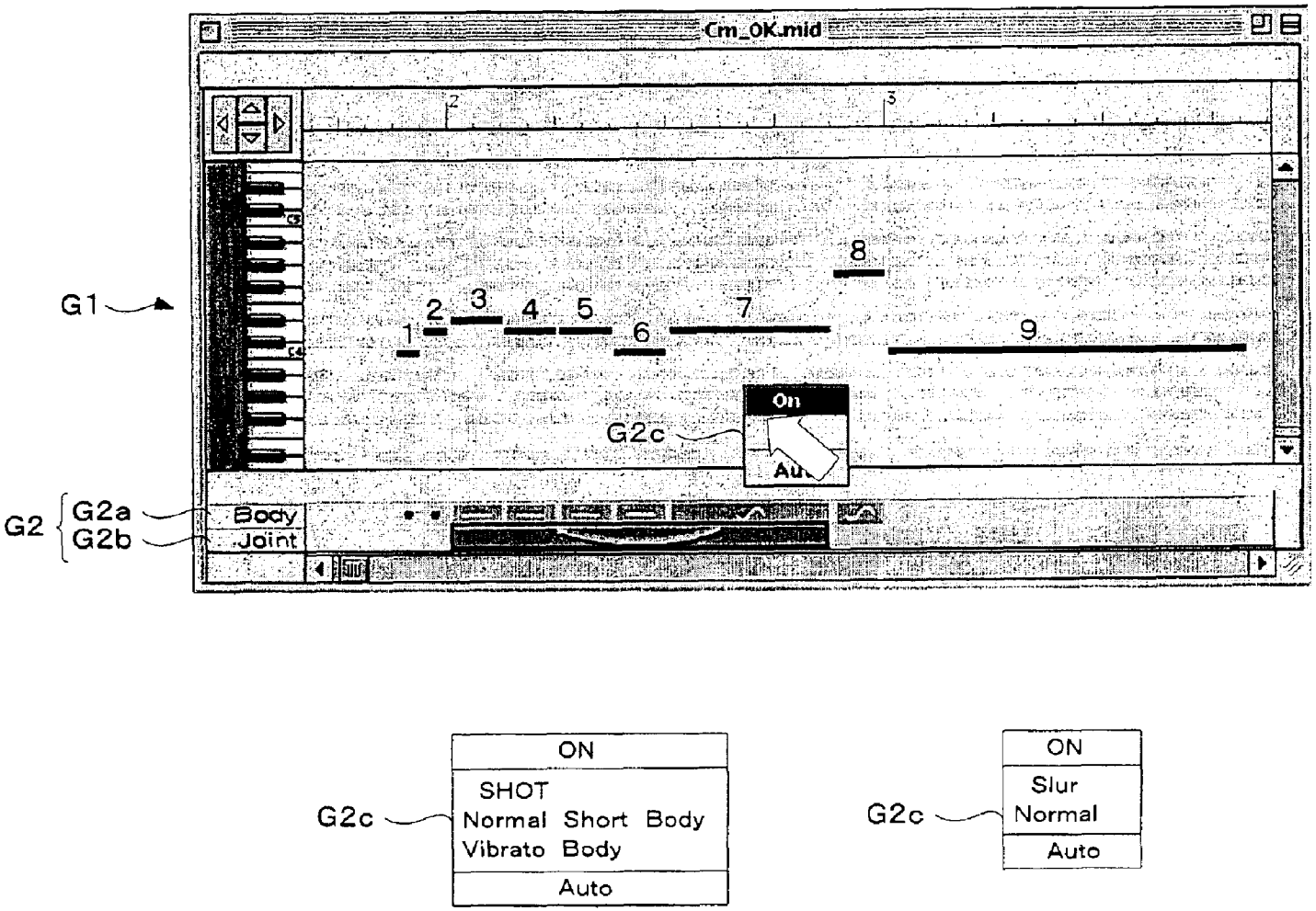
FIG. 4 is a diagram showing an example of a rendition style displaying/editing screen displayed on a display device of the electronic musical instrument.

This and following paragraphs describe in greater detail the "rendition style displaying/editing screen" that is displayed on the display device 7 in accordance with the screen display instruction given from the music-piece-data managing/reproducing section M1, with reference to FIG. 4. FIG. 4 is a diagram showing an example of the rendition style displaying/editing screen. The rendition style displaying/editing screen is a screen for displaying music piece data and rendition styles in respective predetermined display styles so that the user can manually edit the notes and rendition styles. Reference numerals "1"–"9" are attached to the individual displayed notes in the music piece data merely for the purpose of facilitating the explanation, and these reference numerals "1"–"9" are not necessarily displayed on the actual rendition style displaying/editing screen.

As seen from the illustration of FIG. 4, the rendition style displaying/editing screen displayed on the display device 7 includes at least a music piece information display section G1 positioned in an upper portion thereof for displaying music piece information based on music piece data in such a manner that the user is allowed to edit the displayed music piece information, and a rendition style display section G2 positioned in a lower portion thereof for displaying rendition styles in such a manner that the user is allowed to edit any of the displayed rendition styles. Specifically, the music piece information display section G1 in the upper portion of the screen is provided for displaying, in a predetermined display style, tones based on the music piece data input to the music-piece-data managing/reproducing section M1. In the illustrated example of FIG. 4, the music piece information display section G1 shows music-piece-data-based music piece information in a piano roll indicating positions on a keyboard to be operated in order to perform individual notes of the music piece data and keyboard-operating times of the individual notes. It should be obvious that the music-piece-data-based music piece information may be displayed using a musical score or the like rather than using such a piano roll. Editing of the music piece data thus displayed using a piano roll or the like is well known in the art and is therefore not described here.

On the other hand, the rendition style display section G2 positioned in the lower portion of the rendition style displaying/editing screen is provided for displaying, in a predetermined display style, rendition styles imparted to the music piece data. In the illustrated example of FIG. 4, the rendition style display section G2 indicates body-related and joint-related rendition styles at separate locations using respective icons. Specifically, a body displaying/editing region G2*a* of the rendition style display section G2 indicates body-related rendition styles, currently imparted to the music piece data, using icons representative of respective types of the body-related rendition styles. For example, the Shot is indicated with a dot-shaped icon (•), the Normal Short Body with a bar-shaped icon, the Vibrato Body with a wave-shaped icon, and so on. In the illustrated example of FIG. 4, dot-shaped icons are displayed in relation to first and second notes, from which it can be seen that the first and second notes represent shot tones. Similarly, bar-shaped icons are displayed in relation to third to sixth notes, from which it can be seen that the third to sixth notes represent tones each having the normal short body. Further, wave-shaped icons are displayed in relation to seventh to ninth notes, from which it can be seen that the seventh to ninth notes represent tones each having the vibrato body.

Joint displaying/editing region G2*b* of the rendition style display section G2 indicates joint-related rendition styles, currently imparted to the music piece data, using a predetermined icon. The Slur Joint alone is indicated with a slur icon, while the Normal Joint is not indicated with any icon. The reason why the Normal Joint is not indicated with any icon is that, if the Normal Joint too is displayed with a separate icon, the overall display would become so complicated that the user can not properly ascertain other important rendition styles despite the fact that there is no need for the user to pay particular attention to the Normal Joint at the time of production of tones. Therefore, if appropriate, i.e. if no significant complication or inconvenience is caused, a predetermined dedicated icon may of course be allocated to indicate the Normal Joint. Further, if a plurality of the Slur Joints are to be indicated with the slur icon, they may be indicated collectively with a single icon; such an approach is preferable in that it can prevent the overall display from becoming complicated, can indicate the Slur Joints in much the same style as a slur mark in an ordinary musical score and also allows the user to readily understand, at the time of production of tones, that the slur joints are currently imparted to the music piece data. Of course, one slur icon representing the Slur Joint may alternatively be displayed per tone in question. On such a rendition style displaying/editing screen, rendition styles manually set by the user and rendition styles automatically determined and imparted by the rendition style determining section J1 are indicated in different icon display styles. For example, the icons representing rendition styles manually set by the user are displayed in a dark shade of a predetermined color, while the icons representing rendition styles automatically imparted by the rendition style determining section J1 are displayed in a lighter shade of the predetermined color. As another alternative, the icons representing rendition styles manually set by the user and the icons representing rendition styles automatically imparted by the rendition style determining section J1 may be differentiated by different colors, different icon sizes, different outline sizes, different icon shapes, or the like.

In the instant embodiment, the rendition styles manually set by the user and the rendition styles automatically imparted by the automatic rendition style determining section J1 can be edited freely by the user using the rendition style displaying/editing screen. For example, once one of the icons displayed on the rendition style displaying/editing screen is designated, a context menu G2*c* is caused to pop up on the screen as illustrated in FIG. 4, so that the user can use the context menu G2*c* to edit the rendition style represented by the designated icon. When one of the icons displayed in the body displaying/editing region G2*a* has been designated, there are displayed, in the context menu G2*c*, several buttons as illustrated in a lower left portion of the figure, which includes an ON button operable to, for example, replace an automatically-imparted rendition style with a manually-set rendition style and apply the thus manually-set rendition style, a SHOT button operable to replace an automatically-imparted rendition style with a manually-set rendition style but apply the shot rendition style module instead of applying the manually-set rendition style, a Normal Short Body button operable to apply the normal short body, a Vibrato Body button operable to apply the vibrato rendition style module, and an Auto button operable to replace a manually-set rendition style with an automatically-determined rendition style. Once the Auto button is selectively operated, the corresponding rendition style event is deleted from the music piece data set. Generally, there sometimes occurs a possibility that, even when the user considers it unnecessary to change an automatically-imparted rendition style, the automatically-imparted rendition style is influenced by a subsequent change of the rendition style determination conditions (to be later described) and altered without being noticed by the user. Thus, the instant embodiment is arranged to display rendition style designating information manually set by the user and automatically-imparted rendition styles in different display styles and allow the user to previously fix the automatically-imparted rendition styles by operation of the ON button, so as to avoid such an undesired change of the automatically-imparted rendition styles. Further, each time the user has changed to one rendition style to another or replaced a manually-set rendition style with an automatically-determined rendition style, the embodiment changes the icon display states accordingly.

Similarly, when one of the icons displayed in the joint displaying/editing region G2*b* has been designated, there are displayed, in the context menu G2*c*, several buttons as illustrated in a lower right portion of the figure, which includes an ON button, a Slur button operable to apply a slur joint rendition style module, a Normal button operable to apply the normal joint rendition style module, and an Auto button. Thus, the user can visually ascertain rendition styles currently imparted to the music piece data through the rendition style displaying/editing screen displayed on the display device 7.

Whereas the embodiment has been described as displaying only information of one track of music piece data on the piano roll screen, it should be obvious that information of two or more tracks of music piece data may be displayed on the piano roll screen. When rendition styles in a desired one of a plurality of tracks of music piece data are to be edited, the embodiment may be arranged to allow the user to previously designate the desired track. In such a case, the desired track to be subjected to rendition style editing may be indicated with a unique track number or with a unique background such that the user can readily ascertain the track in question.

Figure 5:
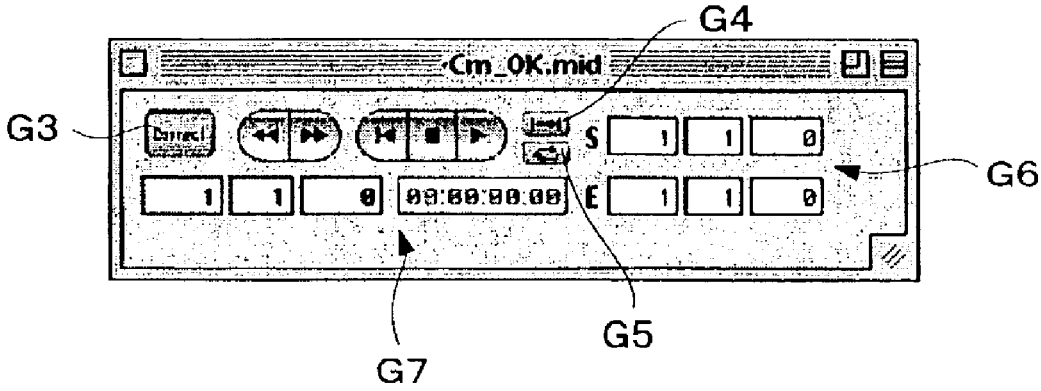
FIG. 5 is a diagram showing an example of a to-be-reproduced-portion designating screen displayed on the display device.

This and following paragraphs describe the to-be-reproduced-portion designating screen displayed on the display device 7 in response to operation of the reproduction designating switch, with reference to FIG. 5 that shows an example of the to-be-reproduced-portion designating screen. The to-be-reproduced-portion designating screen is a screen to be used for designating a range of music piece data to be reproduced and giving a reproduction start instruction.

As seen from FIG. 5, the to-be-reproduced-portion designating screen displays various buttons, such as a Connect button G3 operable to connect the music-piece-data managing/reproducing section M1 to the automatic rendition style determining section J1, a button G4 operable to make effective to-be-reproduced-range designation and a button G5 operable to set whether or not the to-be-reproduced range should be reproduced repetitively in a loop fashion, and various areas, such as a range designating input area G6 for the user to designate a range of the music piece data to be reproduced by directly entering reproduction start and end positions and a reproduced position display area G7 for displaying a currently-reproduced position of the music piece data. Specifically, the Connect button G3 is operable by the user to connect the music-piece-data managing/reproducing section M1 to the automatic rendition style determining section J1 in order to reproduce music piece data or instruct the determining section J1 to perform automatic determination of rendition styles. Upon depression of the Connect button G3, results of the automatic rendition style determination (determined rendition styles) are displayed on the rendition style displaying/editing screen along with the manually-set rendition styles. When the Connect button G3 is not depressed, only the manually-set rendition styles are displayed on the rendition style displaying/editing screen. The button G4 for making effective to-be-reproduced-range designation is arranged to set the music piece to be reproduced only over the designated to-be-reproduced range, by making effective reproduction start and end positions entered in the range designating input area G6. The button G5 for setting whether or not the to-be-reproduced range should be reproduced repetitively in a loop fashion is arranged to set the music piece data to be reproduced repetitively in a loop fashion over the designated to-be-reproduced range having been made effective as above. The range designating input area G6 is a data entry area for the user to designate a range of the music piece data to be reproduced, and the reproduced position display area G7 is a data display area for displaying a currently-reproduced position of the music piece data. In the range designating input area G6 and reproduced position display area G7, there can be entered or displayed reproduction start and end positions and currently-reproduced position in terms of the measure, beat and tick (e.g., sub-beat). The reproduced position display area G7 may also indicate a currently-reproduced position in an elapsed time (which, in this case, is represented by the hour, minute, second and hundredth of a second) from the beginning of the music piece, in addition to or in place of the measure, beat and tick (e.g., sub-beat).

Figure 6:
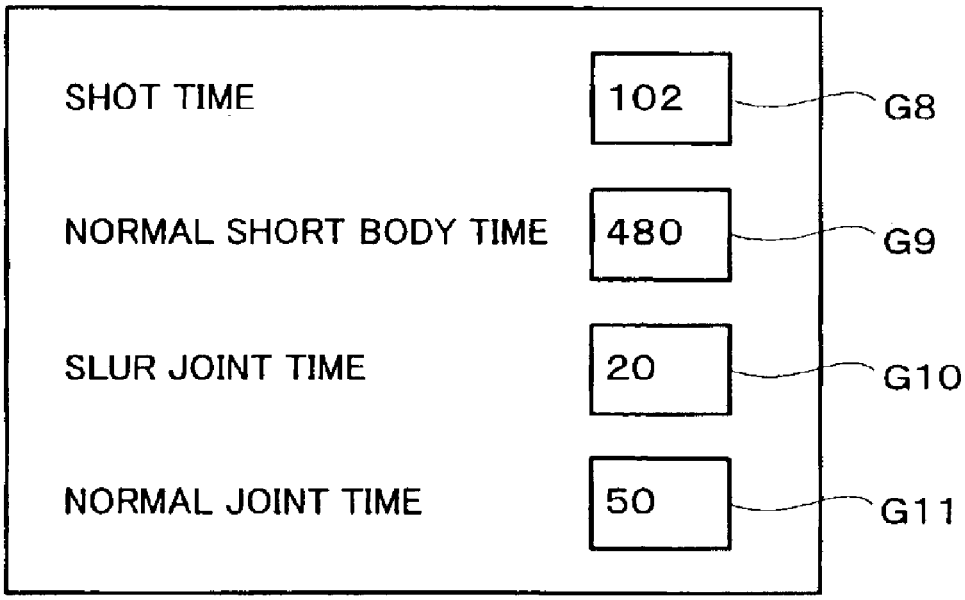
FIG. 6 is a diagram showing an example of a determination condition inputting screen.

This and following paragraphs describe the determination condition inputting screen displayed on the display device 7 in response to operation of the determination condition inputting switch, with reference to FIG. 6 that shows an example of the determination condition inputting screen. The determination condition inputting screen is a screen for changing the rendition style determination conditions to be used for automatic rendition style impartment.

As seen from FIG. 6, the determination condition inputting screen displayed on the display device 7 is a screen for the user to enter rendition style determination conditions for determining which rendition styles are to be imparted as a body-related rendition style, such as the shot, normal short body or vibrato body, and as a joint-related rendition style, such as a slur joint or normal joint. The determination condition inputting screen includes input areas G8–G11 via which a shot time and normal short body time functioning as rendition style determination conditions for the body-related rendition style and a slur joint time and normal joint time functioning as rendition style determination conditions for the joint-related rendition style are set to respective desired values. The shot time represents a threshold note length value to be used for determining whether the whole of a given tone should be formed as a shot tone (i.e., using the shot rendition module) or as an ordinary tone (i.e., using a combination of an attack-related rendition style module and body-related rendition style module or joint-related rendition style module). Further, the normal short body time represents a threshold note length value to be used for determining whether the body portion of a given ordinary tone should be formed as the normal short body or vibrato body (i.e., using the normal short body rendition style module or vibrato body rendition style module). Furthermore, the slur joint time represents a threshold rest length value to be used for determining which one of a slur joint and normal joint should be used between given tones. Furthermore, the normal joint time represents a threshold rest length value to be used for determining whether a combination of release-related and attack-related rendition style modules should be used, with no joint-related rendition style module, between tones (i.e., a preceding tone should end with a release-related rendition style module and then a succeeding tone should rise with an attack-related rendition style module) or a joint-related rendition style modules should be used between the tones. The automatic rendition style impartment using such rendition style determination conditions will be described later in relation to the automatic rendition style determining processing of FIG. 7.

Figure 7:
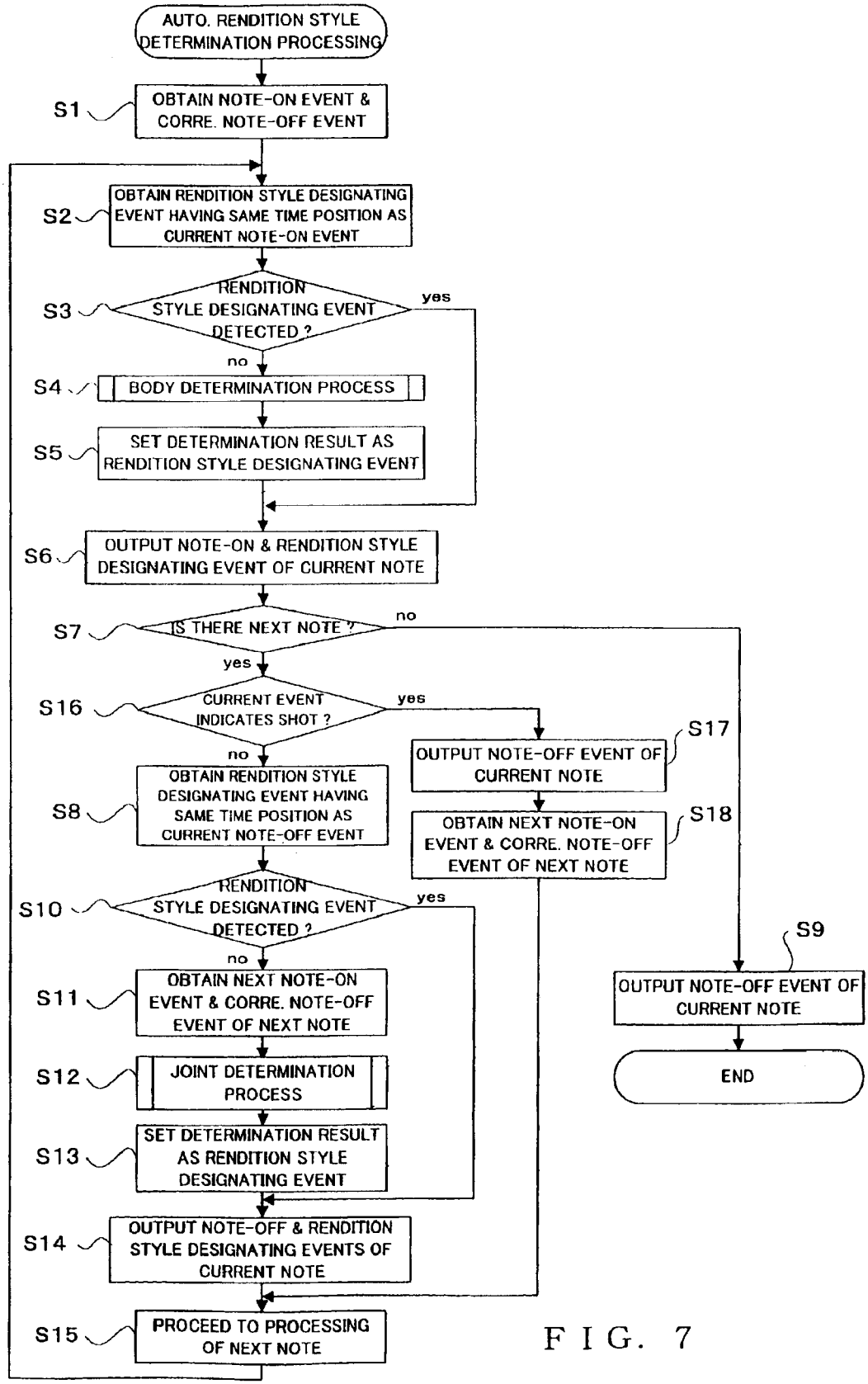
FIG. 7 is a flow chart showing an example step sequence of automatic rendition style determining processing executed by a CPU of the electronic musical instrument.

As discussed earlier, if a music piece data set is constructed only of time, note length and note pitch information concerning a series of notes, the music piece data set would be reproduced as a mechanical, expressionless performance that is extremely musically unnatural. Thus, to achieve a more natural, beautiful and vivid performance, it is considered advantageous to impart the music piece data with performance information representative of rendition styles peculiar to a desired one of various musical instruments, because such an approach can appropriately express peculiar characteristics of the desired musical instrument. For example, in stringed instruments like a guitar and bass, the "choking" is a well-known rendition style. Using such a choking rendition style in interleaved combination with ordinary rendition styles, it is possible to create a natural performance with characteristic expressions peculiar to a guitar. For these reasons, the rendition style determining apparatus of the present invention is constructed to automatically impart music piece data with performance information concerning rendition styles peculiar to a given musical instrument. FIG. 7 is a flow chart showing an example step sequence of the automatic rendition style determining processing executed, by the CPU 1 of the electronic musical instrument, for automatically impart music piece data with performance information representative of rendition styles peculiar to a given musical instrument. The automatic rendition style determining processing is executed by the CPU 1 in response to operation of an automatic expression imparting switch on the panel operator unit 6.

At step S1, a note-on event and corresponding note-off event of a note are obtained from among event data included in a music piece data set. Namely, note-on and note-off events of the note are obtained from the music piece data set in accordance with predetermined performance order, so as to determine a performance starting time and performance ending time of the note. At step S2, a rendition style designating event which is set to the same time position as the current note-on event is obtained from the music piece data set. Namely, the music piece data set is searched for a rendition style designating event having no time interval from the current note-on event is obtained from. At step S3, a determination is made as to whether or not any rendition style designating event having no time interval from the current note-on event has been detected. If such a rendition style designating event has been detected, i.e. if a certain rendition style, such as a rendition style manually imparted by the user or previously defined in the music piece data set, is already imparted to the current note, (YES determination at step S3), the current note is not subjected to an automatic rendition style impartment process, so that the processing jumps to step S6. If, on the other hand, no rendition style is currently imparted to the note (NO determination at step S3), a body determination process is carried out at step S4, and a result obtained through the body determination process is set as a rendition style designating event at step S5.

At step S6, the thus-set rendition style designating event is output as a determined rendition style along with the current note (see FIG. 3). Namely, if there has been detected a rendition style designating event for the current note-on event at step S3, the detected rendition style designating event is directly output along with the note-on event. If, on the other hand, no rendition style designating event has been detected for the current note-on event, a rendition style designating event corresponding to a body-related rendition style, such as the normal short body, vibrato body or shot rendition style, obtained through the body determination process, is output along with the note-on event. At that time, the body-related rendition style is set to the same time (same time position) as the note-on event. Note that the other body-related rendition style than the shot rendition style may be set to an appropriate time position between the note-on and note-off times (i.e., a predetermined time after the note-on event of the current note but before the note-off event of the current note).

At step S7, it is determined whether the music piece data set include a next note, i.e. whether the music piece will last even after the current note instead of ending with the current note. If there is no next note in the music piece data set, i.e. if the music piece ends with the current note, as determined at step S7 (NO determination), the note-off event of the current note is output at step S9. If there is the next note, i.e. if the music piece will last even after the current note, as determined at step S7 (YES determination), a further determination is made at step S16 as to whether or not the body rendition style designating event of the current note indicates the shot rendition style. If the current note is of the shot rendition style covering an entire tone (YES determination at step S16), the note-off event of the current note is output at step S17 since no joint-related rendition style is used, and then note-on and note-off events of the next note are obtained from the music piece data set at step S18 so that the rendition style determination processing proceeds to processing of the next note at step S15. If the current note is not of the shot rendition style (NO determination at step S16), the music piece data set is searched at step S8 for a rendition style designating event which is set to the same time position as the current note-off event; that is, a rendition style designating event having no time interval from the current note-off event is searched for in the music piece data set. At next step S10, a determination is made as to whether or not a rendition style designating event having no time interval from the current note-off event has been detected from the music piece data set. With an YES determination at step S10, namely, if a certain rendition style has already been imparted between the preceding note (current note of step S2) and the succeeding note (next note of step of step S7), the current note is not subjected to the automatic rendition style impartment process, so that the processing jumps to step S14.

If, on the other hand, there has been detected no rendition style designating event, i.e. if no rendition style is currently imparted between the preceding note and the succeeding note, (NO determination at step S10), a note-on event and corresponding note-off event of the next note are obtained from among event data included in the music piece data set, at step S11. Namely, note-on and note-off events of the next notes are obtained from the music piece data set in accordance with the performance order, so as to determine performance starting and ending times of the next note. Then, a joint determination process is carried out on the basis of the note-off event of the current note and the note-on event of the next note at step S12, and a result obtained through the joint determination process is set as a rendition style designating event at step S13. At next step S14, the thus-set rendition style designating event is output as a determined rendition style along with the note-off event of the current note (see FIG. 3). Namely, if there has been detected a certain rendition style designating event at step S10, the detected rendition style designating event is output along with the note-off event, but if there has been detected no rendition style designating event, the rendition style designating event, representing the joint-related rendition style obtained through the joint determination process is output along with the note-off event. At that time, the joint-related rendition style is set to the same time (same time position) as the note-off event. Then, at step S15, the processing repeats the operations at and after step S2 on the next note. By thus repeating the operations of steps S2–S18 on all notes of the music piece data set, the automatic rendition style determination processing imparts rendition styles to the music piece data while sequentially determining, on the note-by-note basis, whether or not the rendition style impartment is proper or improper (necessary or unnecessary).

Figure 8:
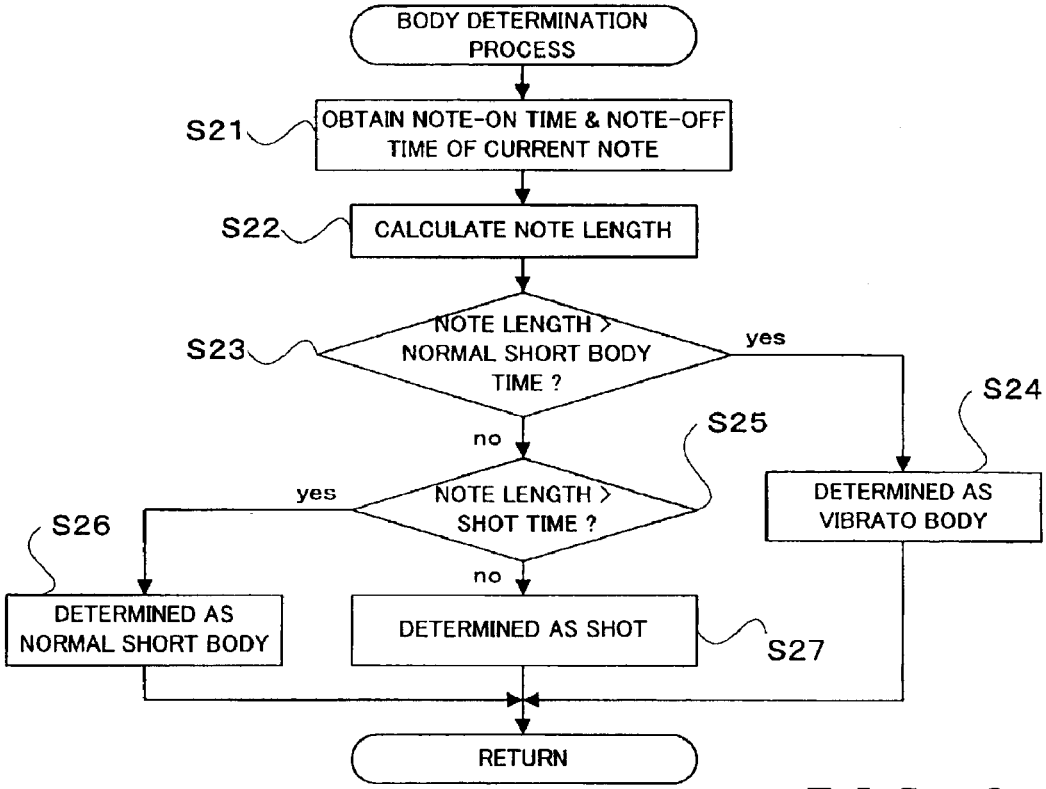
FIG. 8 is a flow chart of an example of a body determination process executed by the CPU.

Next, the body determination process will be described in detail. FIG. 8 is a flow chart of an example step sequence of the body determination process executed at step S4 of the automatic rendition style determination processing of FIG. 7.

At first step S21, the note-on time and corresponding note-off time of the current note are obtained. At next step S22, the obtained note-off time is subtracted from the obtained note-on time so as to calculate a note length of the current note. Namely, the time length, from the performance start time to the performance end time, of the note is calculated. Note that the terms "note length" refer to a note-on lasting time (time from note-on timing to note-off timing), rather than a musically-fixed note length such as a quarter note length or eighth note length. At step S23, a determination is made as to whether or not the obtained note length is greater than a normal short body time. Here, the normal short body time is a parameter representative of a time length prestored in the ROM 2 or entered by the user using the determination condition inputting screen. If the obtained note length is greater than the normal short body time (YES determination at step S23), it is determined at step S24 that the vibrato body rendition style module is to be used as the body-related rendition style of the current note. If, on the other hand, the obtained note length is not greater than the normal short body time (NO determination at step S23), a further determination is made as to whether or not the obtained note length is greater than a short time, at step S25. The shot time is a parameter representative of a time length, shorter than the normal short body time, prestored in the ROM 2 or entered by the user using the determination condition inputting screen. If the obtained note length is not greater than the shot time (NO determination at step S25), it is determined at step S27 that the shot rendition style module is to be used as the rendition style of the entire note. If, on the other, the obtained note length is greater than the shot time (YES determination at step S25), it is determined at step S26 that it is determined at step S26 that the normal short body rendition style module is to be used as the body-related rendition style of the current note. Namely, the body determination process determines a particular type of body-related rendition style module or shot-related rendition style module by making the determination using a combination of note-on and note-off events of a particular note.

Figure 9:
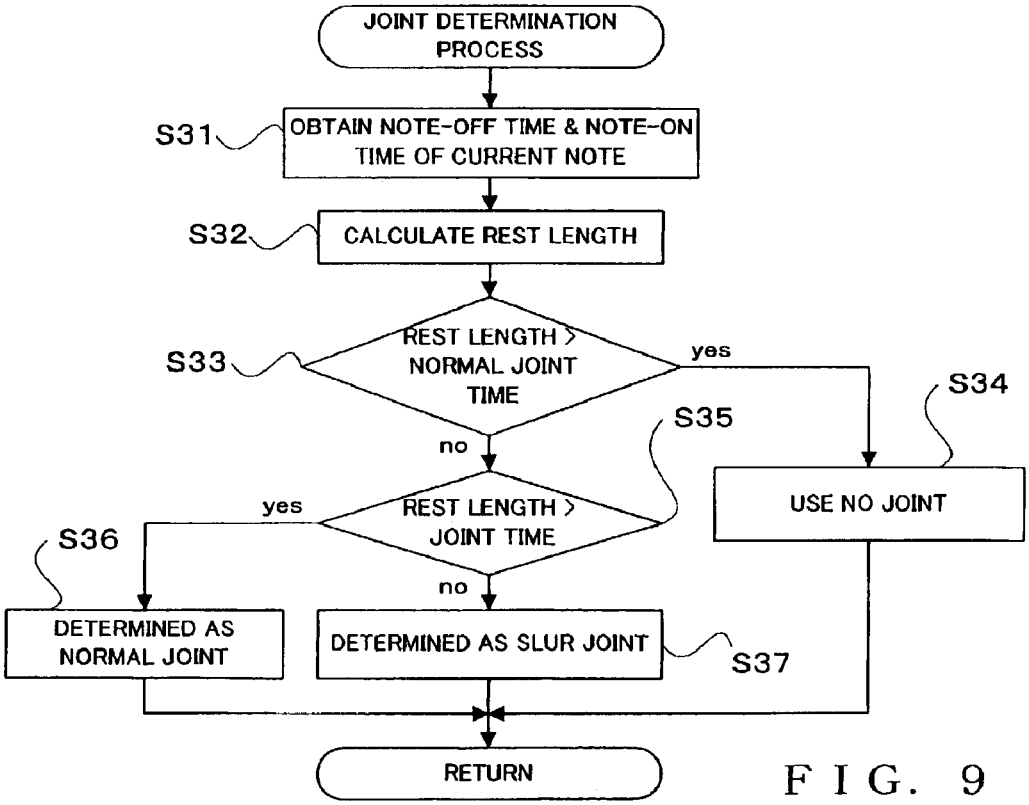
FIG. 9 is a flow chart of an example of a joint determination process executed by the CPU.

Next, the joint determination process will be described in detail. FIG. 9 is a flow chart of an example step sequence of the joint determination process executed at step S12 of the automatic rendition style determination processing of FIG. 7.

At first step S31, the note-off time of the current note and the note-on time of the next note, following the current note, are obtained. At next step S32, the obtained note-off time of the current note is subtracted from the obtained note-on time of the next note so as to calculate a length of a rest between the current note and the next note. Namely, the time length from the performance end time of the current note to the performance start time of the next note is calculated. Note that the terms "rest length" refer to a time interval between the note-off time of a preceding note and the note-on time of a succeeding note, i.e. time interval between successive notes, rather than a musically-fixed rest length such as an eighth rest or quarter rest. At step S33, a determination is made as to whether or not the obtained rest length is greater than the normal joint time. Here, the normal joint time is a parameter representative of a time length prestored in the ROM 2 or entered by the user using the determination condition inputting screen. If the obtained rest length is greater than the normal joint time (YES determination at step S33), it is determined at step S34 that the current note is an independent note and thus no joint-related rendition style module is to be used for the current note. If, on the other hand, the obtained rest length is not greater than the normal joint time (NO determination at step S33), a further determination is made as to whether or not the obtained rest length is greater than a slur joint time, at step S35. The slur joint time is a parameter representative of a time length, shorter than the normal joint time, prestored in the ROM 2 or entered by the user using the determination condition inputting screen. If the obtained rest length is not greater than the slur joint time (NO determination at step S35), it is determined at step S37 that the current note is connected continuously with the next note via a slur and thus the slur joint is to be used as the joint-related rendition style of the entire note. If, on the other, the obtained rest length is greater than the slur joint time (YES determination at step S35), it is determined at step S36 that the normal joint is to be used as the joint-related rendition style of the current note. Namely, the joint determination process determines a particular type of joint-related rendition style module by making the determination using a combination of a note-off event of a given note and a note-on event of the following note.

Figure 10A:
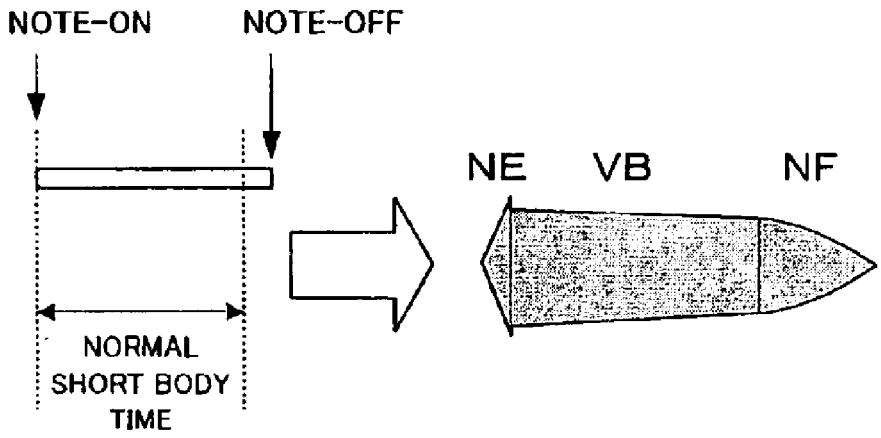
FIGS. 10A–10C are conceptual diagrams showing tone waveforms produced in correspondence with note lengths of a given note.
Figure 10B:
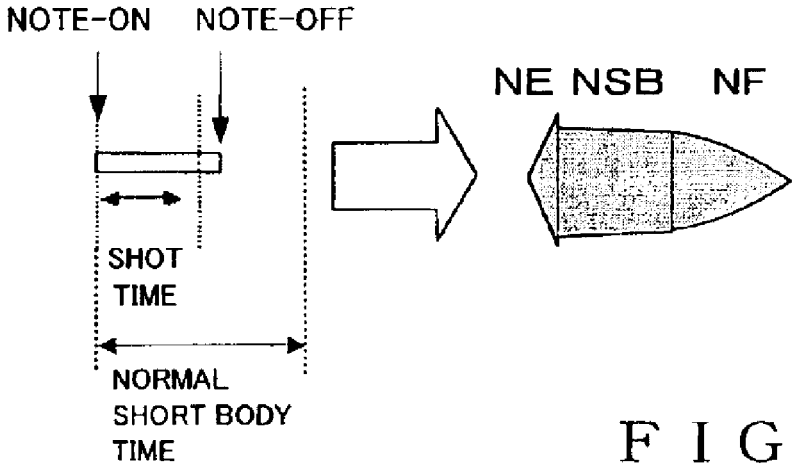
Figure 10C:
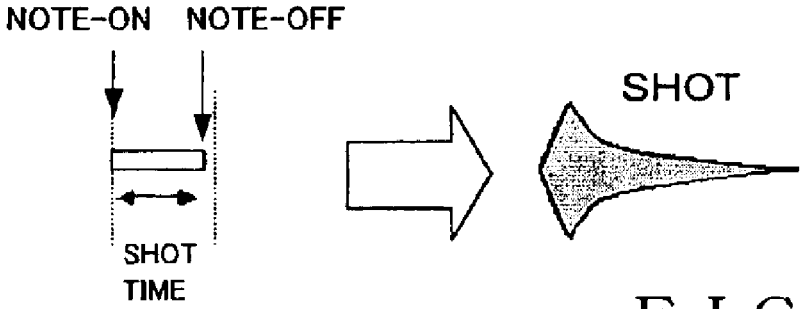

The following paragraphs describe waveforms ultimately produced on the basis of the results of the above-described body determination process and joint determination process. First, waveforms produced on the basis of the result of the body determination process will be described, with reference to FIGS. 10A–10C that are conceptual diagrams showing tone waveforms produced in correspondence with different note lengths of a given note. Specifically, in these figures, timewise relationships between the rendition style determination conditions and the note lengths are depicted on left side portions of the figures, while envelope shapes of the waveforms produced on the basis of determined rendition styles are depicted on right side portions of the figures.

Where the time length (i.e., note length depicted in each of the figures by a thin rectangle) determined on the basis of the note-on and note-off times of the given note is greater than the normal short body time, the vibrato body is selected as the body-related rendition style (see step S24 of FIG. 8). Namely, in this case, the waveform of the given note is expressed by a combination of the normal entrance (NE), vibrato body (VB) and normal finish (NF), as illustrated in FIG. 10A. Where the time length of the given note is smaller than the normal short body time but greater than the shot time, the normal short body is selected as the body-related rendition style (see step S26 of FIG. 8). Namely, in this case, the waveform of the given note is expressed by a combination of the normal entrance (NE), normal short body (NSM) and normal finish (NF), as illustrated in FIG. 10B. Further, where the time length of the given note is smaller than the shot time, the shot rendition style module is selected as the body-related rendition style (see step S27 of FIG. 8). Namely, in this case, the waveform of the given note is expressed by the shot (SHOT) rendition style module alone rather than a combination of the normal entrance, normal short body and normal finish, as illustrated in FIG. 10C. Namely, in the case where the note length of a given note having no rendition style imparted thereto in the music piece data set is greater than the normal short body time, the waveform of the given note is expressed by adding the vibrato body to the combination of the normal entrance and normal finish. In the case where the note length of the given note is smaller than the normal short body time but greater than the shot time, the waveform of the given note is expressed by adding the normal short body to the combination of the normal entrance and normal finish. Further, in the case where the note length of the given note is smaller than the shot time, the waveform of the given note is expressed by the shot rendition style module alone without the combination of the normal entrance and normal finish being used.

Figure 11A:
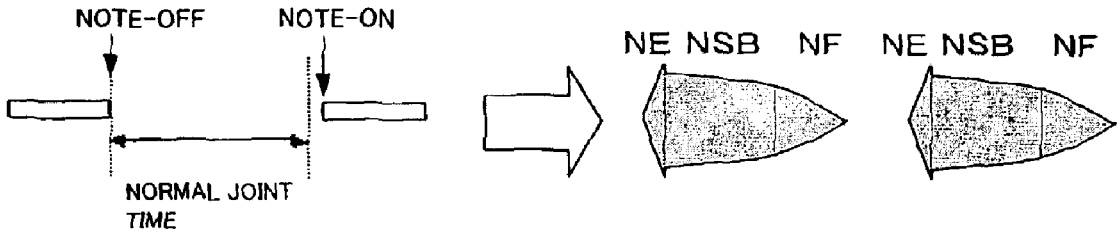
FIGS. 11A–11C are conceptual diagrams showing continuously-connected tone waveforms produced in correspondence with various lengths of a rest between a given note and a next note.
Figure 11B:
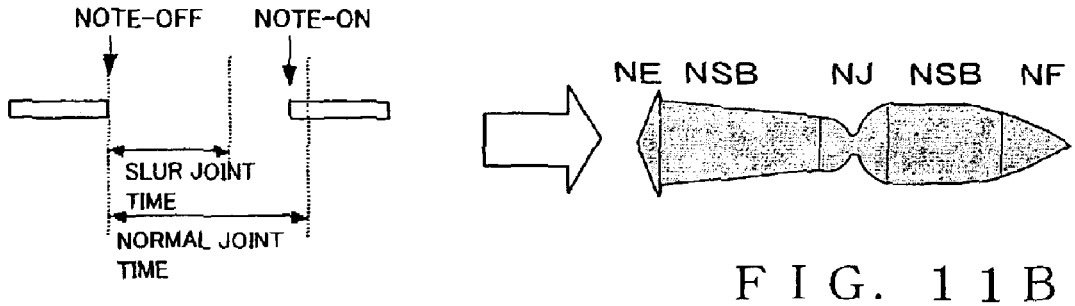
Figure 11C:
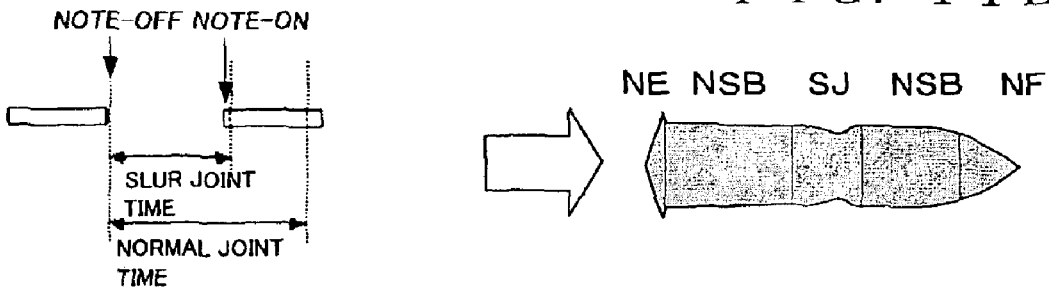

Next, waveforms produced on the basis of the result of the joint determination process will be described, with reference to FIGS. 11A–11C that are conceptual diagrams showing tone waveforms produced in correspondence with different lengths of a rest from a given note to a next note immediately following the given note. Specifically, in these figures, timewise relationships between the rendition style determination conditions and the rest lengths are depicted on left side portions of the figures, while envelope shapes of the waveforms produced on the basis of determined rendition styles are depicted on right side portions of the figures. In the illustrated examples of these figures, the normal short body is designated or determined through the body determination process, as the body-related rendition style for the given note and next note.

Where the time length (i.e., rest length between the end of the given (preceding) note and the beginning of the next (succeeding) note that are depicted in each of the figures by a thin rectangle determined on the basis of the note-off time of the given note and note-on time of the next note is greater than the normal joint time, no joint-related rendition style is selected (see step S34 of FIG. 9). Thus, in this case, the waveform of each of the given and next notes is expressed by a combination of the normal entrance, normal short body and normal finish, as illustrated in FIG. 11A; namely, each of the given and next notes is expressed by an independent tone waveform that is not connected with a tone waveform of the other note via the joint-related rendition style module. Where the rest length between the two successive notes is smaller than the normal joint time but greater than the slur joint time, the normal joint is selected as the joint-related rendition style module (see step S36 of FIG. 9). Thus, in this case, the waveforms of the two successive notes are expressed using the normal joint rendition style module to replace the normal finish rendition style module of the preceding note and normal entrance rendition style module of the succeeding note. Further, where the rest length between the two successive notes is smaller than the slur joint time, the slur joint is selected as the joint-related joint rendition style (see step S37 of FIG. 9). Thus, in this case, the waveforms of the two successive notes are expressed using the slur joint rendition style module to replace the normal finish rendition style module of the preceding note and normal entrance rendition style module of the succeeding note. Namely, in the case where the length of a rest between successive notes having no rendition style imparted thereto in the music piece data set is greater than the normal joint time, the trailing end portion of the preceding note is caused to end with the normal finish rendition style module while the leading end portion of the succeeding note is caused to start with the normal finish rendition style module, so that the individual notes are expressed as independent tones. In the case where the rest length between the two successive notes is smaller than the normal joint time but greater than the slur joint time, the two notes are expressed with continuously-connected waveforms using the normal joint rendition style module. Further, in the case where the rest length between the two successive notes is smaller than the slur joint time, the two notes are expressed with continuously-connected waveforms using the slur joint rendition style module.

Note that the technique for combining attack-related, body-related and release-related rendition style modules (or joint-related rendition style module) to produce a waveform of the whole of a tone or successive tones is known in the art and thus is not described here.

Further, whereas the automatic rendition style determining section J1 in the instant embodiment has been described as outputting, as a determined rendition style, rendition-style designating event information through the automatic rendition style determination processing (see steps S6 or S14 of FIG. 7), the determining section J1 may alternatively output a rendition style waveform itself. In such a case, the rendition style waveform may be visually displayed on the rendition style displaying/editing screen.

Further, the embodiment has been described in relation to the case where the music-piece-data managing/reproducing section M1 is connected to the only one automatic rendition style determining section J1 in response to depression or operation of the Connect button G3. Alternatively, there may be provided two or more automatic rendition style determining sections J1 so that the music-piece-data managing/reproducing section M1 can be connected to one of the rendition style determining sections J1 that is selected in accordance with the number of times the Connect button G3 is operated successively. Namely, a plurality of automatic rendition style determining sections J1 may be connected with the music-piece-data managing/reproducing section M1 so that any one of the determining sections J1 can be selected to perform the rendition style determination in accordance with the number of depressions of the Connect button G3. With this alternative, the user can automatically impart rendition styles on the basis of different sets of rendition style determination conditions by only operating the Connect button G3. Namely, with the alternative arrangement that different sets of rendition style determination conditions are preset in corresponding relation to different tone generators, such as guitar, piano and saxophone tone generators, rendition styles optimal to any selected one of the tone generators can be automatically imparted to optimal performance positions of a music piece data set, which is very convenient to the user. More specifically, a plurality of the automatic rendition style determining sections J1, where respective sets of rendition style determination conditions are set in advance, are provided in corresponding relation to the different tone generators, and any one of the determining sections J1 can be selected by operation of the Connect button G3 so that the selected determining section J1 performs the rendition style determination in accordance with its own set of rendition style determination conditions.

Furthermore, whereas the embodiment has been described in relation to the case where the software tone generator operates in a monophonic mode to generate one tone at a time, the software tone generator may operate in a polyphonic mode to generate two or more tones at a time. In such a case, the electronic musical instrument may perform only the body determination process without performing the joint determination process, so as to handle each note as an independent note. Moreover, the music-piece-data managing/reproducing section M1 may be arranged to divide a music data set into a plurality of monophonic sequences so that the divided monophonic sequences are processed by a plurality of automatic rendition style determining functions. In such a case, the divided monophonic sequences may be displayed by the rendition style displaying/editing section M2, so as to allow the user to ascertain and modify rendition styles imparted to the monophonic sequences It should also be appreciated that the waveform data employed in the present invention may be other than those constructed using rendition style modules as described above, such as waveform data sampled using the PCM, DPCM, ADPCM or other scheme. Namely, the tone generator 8 may employ any of the known tone signal generation techniques such as: the memory readout method where tone waveform sample value data stored in a waveform memory are sequentially read out in accordance with address data varying in response to the pitch of a tone to be generated; the FM method where tone waveform sample value data are acquired by performing predetermined frequency modulation operations using the above-mentioned address data as phase angle parameter data; and the AM method where tone waveform sample value data are acquired by performing predetermined amplitude modulation operations using the above-mentioned address data as phase angle parameter data. Other than the above-mentioned, the tone generator 8 may use the physical model method, harmonics synthesis method, formant synthesis method, analog synthesizer method using VCO, VCF and VCA, analog simulation method, or the like. Further, a plurality of tone generation channels may be implemented either by using a single circuit on a time-divisional basis or by providing a separate circuit for each of the channels.

In the case where the above-described rendition style determining apparatus of the invention is applied to an electronic musical instrument as above, the electronic musical instrument may be of any type other than the keyboard instrument type, such as a stringed, wind or percussion instrument type. In such a case, the present invention is of course applicable not only to such an electronic musical instrument where all of the tone generator, musical expressing imparting device for imparting music piece data with musical expressions, etc. are incorporated together as a unit within the musical instrument, but also to another type of electronic musical instrument where the above-mentioned tone generator, musical expressing imparting device, etc. are provided separately and interconnected via communication facilities such as a MIDI interface, various networks and the like. Further, the rendition style determining apparatus of the invention may comprise a combination of a personal computer and application software, in which case various processing programs may be supplied to the apparatus from a storage media such as a magnetic disk, optical disk or semiconductor memory or via a communication network. Furthermore, the rendition style determining apparatus of the present invention may be applied to automatic performance devices like player pianos, electronic game devices, portable communication terminals like portable phones, etc. Further, in the case where the rendition style determining apparatus of the present invention is applied to a portable communication terminal, part of the functions of the portable communication terminal may be performed by a server computer so that the necessary functions can be performed cooperatively by the portable communication terminal and server computer.

In summary, the present invention is characterized in that a rendition style peculiar to a given musical instrument to be automatically imparted to music piece data is determined in accordance with a note length or rest length corresponding to a note event of the music piece data. Thus, the user is allowed to change appropriately the rendition style to be automatically imparted, by just changing time-related rendition style determination (impartment) conditions. As a consequence, the user can advantageously execute desired rendition style impartment to the music piece data with an increased efficiency.

Further, the present invention is characterized by allowing results of the automatic rendition style determination to be fed back to external equipment, such as a sequencer, connected to the rendition style determining apparatus. This arrangement allows the user to ascertain the automatic rendition style determination results, by other approaches than actually reproducing the music piece data having been imparted with the rendition style.

The present invention is also characterized in that, in response to a rendition style determination instruction, the predetermined rendition style determination device, connected to the rendition style editing apparatus, sends results of the rendition style determination so that the rendition style determined by the determination device can be visually displayed on the basis of the rendition style determination results. With this arrangement, the user can automatically impart a rendition style to music piece data having no rendition style previously imparted thereto, by only connecting the rendition style editing apparatus with the rendition style determination device. Namely, the user can advantageously execute desired rendition style impartment to the music piece data with an increased efficiency.

The present invention relates to the subject matter of Japanese Patent Application Nos. 2002-076674 filed on Mar. 19, 2002, disclosure of which is expressly incorporated herein by reference in its entirety.

What is claimed is:

1. A rendition style determining apparatus comprising:

a music piece data acquisition section that acquires music piece data for performing a given music piece;

a detection section that, on the basis of the music piece data acquired by said music piece data acquisition section, detects at least one of duration of a first note to be performed at a given time point and a time interval between said first note and a second note to be performed following said first note; and a rendition style determination section that, on the basis of the at least one of the duration and time interval detected by said detection section, determines a rendition style to be imparted to the music piece data in relation to the given time point.

2. A rendition style determining apparatus as claimed in claim 1 which further comprises a condition setting section that sets a rendition style determination condition to be used as a criterion for said rendition style determination section to determine a rendition style, the rendition style determination condition comprising one or more reference time lengths for determining each of one or more rendition styles, and wherein said rendition style determination section determines the rendition style to be imparted in relation to the given time point, by comparing the detected duration or time interval to the reference time lengths.

3. A rendition style determining apparatus as claimed in claim 1 wherein the music piece data acquired by said music piece data acquisition section includes note designating information that designates a note to be performed and, where a specific rendition style is already designated for a note corresponding to the note designating information, the music piece data also includes rendition style designating information, and wherein, when the acquired music piece data include no rendition style designating information corresponding to the note designating information for the given time point, said detection section and said rendition style determination section perform a process for determining a rendition style for the given time point.

4. A rendition style determining apparatus as claimed in claim 1 wherein said rendition style determination section determines a rendition style for the given time point, by selecting, from among a plurality of predetermined rendition styles, a rendition style optimal for the given time point.

5. A rendition style determining apparatus as claimed in claim 1 which further comprises a connection section for connecting said music piece data acquisition section to a music piece data supply section, and wherein said music piece data acquisition section acquires music piece data from said music piece data supply section via said connection section, and said rendition style determination section supplies rendition style designating information, indicative of a rendition style determined thereby for the given time point, to said music piece data supply section via said connection section.

6. A rendition style determining apparatus as claimed in claim 5 wherein said music piece data supply section includes a storage section storing music piece data and incorporates the supplied rendition style designating information into the music piece data, stored in said storage section, in association with the given time point.

7. A rendition style determining apparatus as claimed in claim 5 wherein the rendition style designating information is event information indicative of a determined rendition style.

8. A rendition style determining apparatus as claimed in claim 1 wherein said rendition style determination section compares the detected duration of said first note to one or more reference time lengths and thereby determines one or more rendition styles characterizing a body of a tone represented by said first note.

9. A rendition style determining apparatus as claimed in claim 1 wherein said rendition style determination section compares the detected time interval between said first note and said second note to one or more reference time lengths and thereby determines one or more rendition styles characterizing a state of connection between said first note and said second note.

10. A rendition style determining method comprising:

a step of acquiring music piece data for performing a given music piece;

a detection step of, on the basis of the music piece data acquired by said step of acquiring, detecting at least one of duration of a first note to be performed at a given time point and a time interval between said first note and a second note to be performed following said first note; and a step of, on the basis of the at least one of the duration and time interval detected by said detection step, determining a rendition style to be imparted to the music piece data in relation to the given time point.

11. A program containing a group of instructions for causing a computer to perform a rendition style determining method, said rendition style determining method comprising:

a step of acquiring music piece data for performing a given music piece;

a detection step of, on the basis of the music piece data acquired by said step of acquiring, detecting at least one of duration of a first note to be performed at a given time point and a time interval between said first note and a second note to be performed following said first note; and a step of, on the basis of the at least one of the duration and time interval detected by said detection step, determining a rendition style to be imparted to the music piece data in relation to the given time point.

12. A rendition style editing apparatus comprising:

a connection section for connecting thereto a determination processing section that performs rendition style determination on the basis of music piece data;

an instruction section that generates a rendition style determination instruction to obtain a rendition style determined by the determination processing section;

a music piece data supply section that, in response to the rendition style determination instruction generated by said instruction section, supplies music piece data to the determination processing section connected to said connection section and thereby causes the determination processing section to perform the rendition style determination based on the music piece data;

a reception section that receives a result of the rendition style determination from the determination processing section; and a display section that, on the basis of the result of the rendition style determination received by said reception section, displays information indicative of a rendition style having been determined by the determination processing section and imparted to the music piece data supplied to the determination processing section.

13. A rendition style editing apparatus as claimed in claim 12 which further comprises a setting section provided for a user to manually set a rendition style, and wherein said display section displays information, indicative of the rendition style manually set by the user via said setting section, in a different display style from a rendition style determined by the determination processing section.

14. A rendition style editing apparatus as claimed in claim 12 which further comprises an editing section that edits the rendition style displayed by said display section.

15. A rendition style editing apparatus as claimed in claim 14 where said editing section is capable of switching, at any desired time, between the rendition style manually set by the user via said setting section and the rendition style determined by said determination processing section, with respect to a given portion of the music piece data.

16. A rendition style editing apparatus as claimed in claim 12 where a plurality of the determination processing sections are connectable to said connection section, and said instruction section includes a selection section that selects any one of said plurality of the determination processing sections, said instruction section instructing the determination processing section, selected via said selection section, to determine a rendition style.

17. A rendition style editing apparatus as claimed in claim 12 where said instruction section is capable of designating a specific range of the music piece data and instructing the determination processing section to determine a rendition style for the designated particular range.

18. A rendition style editing apparatus as claimed in claim 12 where said connection section includes a switch for instructing connection, with the determination processing section, of said connection section.

19. A rendition style editing method comprising:

a step of connecting a determination processing section that performs rendition style determination on the basis of music piece data;

a step of generating a rendition style determination instruction to obtain a rendition style determined by the determination processing section;

a step of, in response to the rendition style determination instruction, supplying music piece data to the determination processing section connected by said step of connecting and thereby causing the determination processing section to perform the rendition style determination based on the music piece data;

a step of receiving a result of the rendition style determination from the determination processing section; and a step of, on the basis of the result of the rendition style determination received by said step of receiving, displaying information indicative of a rendition style having been determined by the determination processing section and imparted to the music piece data supplied to the determination processing section.

20. A rendition style editing method as claimed in claim 19 which further comprises a step of editing the rendition style displayed by said step of displaying.

21. A program containing a group of instructions for causing a computer to perform a rendition style editing method, said rendition style editing method comprising:

a step of connecting a determination processing section that performs rendition style determination on the basis of music piece data;

a step of generating a rendition style determination instruction;

a step of, in response to the rendition style determination instruction, supplying music piece data to the determination processing section connected by said step of connecting and thereby causing the determination processing section to perform the rendition style determination based on the music piece data;

a step of receiving a result of the rendition style determination from the determination processing section; and a step of, on the basis of the result of the rendition style determination received by said step of receiving, displaying information indicative of a rendition style imparted to the music piece data supplied to the determination processing section.

22. A rendition style editing method as claimed in claim 21 which further comprises a step of editing the rendition style displayed by said step of displaying.

* * * * *